US011719073B2

(12) United States Patent
Shirley et al.

(10) Patent No.: US 11,719,073 B2
(45) Date of Patent: Aug. 8, 2023

(54) SNUB FRIENDLY WELLHEAD HANGER

(71) Applicant: Cameron International Corporation, Houston, TX (US)

(72) Inventors: Brandon Blake Shirley, Cypress, TX (US); Juan Carlos Gonzalez, Houston, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 17/390,387

(22) Filed: Jul. 30, 2021

(65) Prior Publication Data

US 2022/0034196 A1 Feb. 3, 2022

Related U.S. Application Data

(60) Provisional application No. 62/706,086, filed on Jul. 31, 2020.

(51) Int. Cl.

| | |
|---|---|
| ***E21B 23/02*** | (2006.01) |
| ***E21B 33/04*** | (2006.01) |
| ***E21B 34/14*** | (2006.01) |
| ***E21B 21/08*** | (2006.01) |

(52) U.S. Cl.
CPC ..... *E21B 34/14* (2013.01); *E21B 21/08* (2013.01); *E21B 23/02* (2013.01)

(58) Field of Classification Search
CPC ..... E21B 23/02; E21B 33/04; E21B 34/14
See application file for complete search history.

(56) References Cited

U.S. PATENT DOCUMENTS

| | | | | |
|---|---|---|---|---|
| 4,794,988 | A | 1/1989 | van Bilderbeek | |
| 4,856,592 | A | 8/1989 | Van Bilderbeek et al. | |
| 4,938,289 | A | 7/1990 | Van Bilderbeek | |
| 5,026,200 | A | 6/1991 | van Bilderbeek | |
| 6,092,596 | A * | 7/2000 | Van Bilderbeek .. | E21B 33/0422 166/89.1 |
| 6,095,243 | A | 8/2000 | Van Bilderbeek et al. | |
| 6,571,877 | B1 | 6/2003 | Van Bilderbeek | |
| 6,595,297 | B2 * | 7/2003 | Dallas ..... | E21B 33/04 166/85.4 |
| 6,662,868 | B1 * | 12/2003 | Van Bilderbeek .. | E21B 33/0422 166/89.1 |
| 6,938,696 | B2 * | 9/2005 | Dallas ..... | E21B 33/04 166/382 |

(Continued)

FOREIGN PATENT DOCUMENTS

WO WO-2021074633 A1 * 4/2021 ..... E21B 23/02

*Primary Examiner* — Matthew R Buck
(74) *Attorney, Agent, or Firm* — Jeffrey D. Frantz

(57) ABSTRACT

A method for snubbing a wellhead hanger into a wellhead is provided. In one embodiment, a snubbing method includes snubbing a tubing hanger into a wellhead housing from a snubbing unit. Snubbing the tubing hanger into the wellhead housing can include lowering the tubing hanger into a bore of the wellhead housing under pressure and allowing fluid in the bore to pass along an exterior of the tubing hanger to balance fluid pressure above and below the tubing hanger as the tubing hanger is lowered. The tubing hanger can be positioned at a location in the bore of the wellhead housing, which can be elastically deformed to grip and secure the tubing hanger at the location in the bore. Additional methods, systems, and devices are also disclosed.

19 Claims, 5 Drawing Sheets

(56) References Cited

U.S. PATENT DOCUMENTS

| | | | | |
|---|---|---|---|---|
| 7,104,318 | B2 | 9/2006 | Hendrie | |
| 7,111,688 | B2 * | 9/2006 | vanBilderbeek .... | E21B 33/0422 166/242.6 |
| 7,128,143 | B2 * | 10/2006 | Van Bilderbeek .. | E21B 33/0422 166/75.13 |
| 7,344,162 | B2 | 3/2008 | Van Bilderbeek | |
| 7,648,176 | B2 | 1/2010 | Van Bilderbeek | |
| 7,740,061 | B2 * | 6/2010 | Van Bilderbeek ..... | E21B 33/03 166/89.1 |
| 9,145,752 | B2 * | 9/2015 | Hendrie ..... | E21B 33/04 |
| 9,273,532 | B2 * | 3/2016 | Hendrie ..... | E21B 33/043 |
| 9,388,656 | B2 * | 7/2016 | Hendrie ..... | E21B 33/043 |
| 10,287,838 | B2 * | 5/2019 | Van Bilderbeek ..... | E21B 23/04 |
| 10,400,511 | B2 | 9/2019 | Netecke et al. | |
| 11,053,769 | B2 * | 7/2021 | Craycraft ..... | E21B 47/10 |
| 2017/0016301 | A1 | 1/2017 | Nguyen | |
| 2020/0284116 | A1 | 9/2020 | Greska | |
| 2022/0034184 | A1 | 2/2022 | Gonzalez et al. | |
| 2022/0034189 | A1 * | 2/2022 | Hendrie ..... | E21B 33/1212 |

* cited by examiner

SNUB FRIENDLY WELLHEAD HANGER

CROSS-REFERENCE TO RELATED APPLICATIONS

This patent application claims benefit of U.S. Provisional Patent Application Ser. No. 62/706,086, filed Jul. 31, 2020, which is entirely incorporated by reference herein.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space. Wells can also include tubing strings that facilitate flow of fluids through the wells. Hangers can be attached to the casing and tubing strings and received within wellheads to enable these tubular strings to be suspended in the wells from the hangers. These hangers may be installed and set under substantial amounts of pressure through snubbing.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to snubbing of wellhead hangers and tubular strings into wellhead assemblies. In some instances, a wellhead hanger is snubbed into a wellhead housing to a setting location in a bore. The wellhead housing is then elastically deformed to securely grip the wellhead hanger at the setting location. A clamp or other gripping device may selectively provide a radially inward compression force that elastically deforms the wellhead housing to grip the wellhead hanger. In at least some instances, the wellhead hanger carries seals that are not energized as the wellhead hanger is moved to the setting location in the bore, allowing fluid in the bore to pass along the exterior of the wellhead hanger as it moves to balance pressure above and below the hanger. When the wellhead hanger is positioned at the setting location, elastic deformation of the wellhead housing grips the wellhead hanger and energizes the carried seals.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
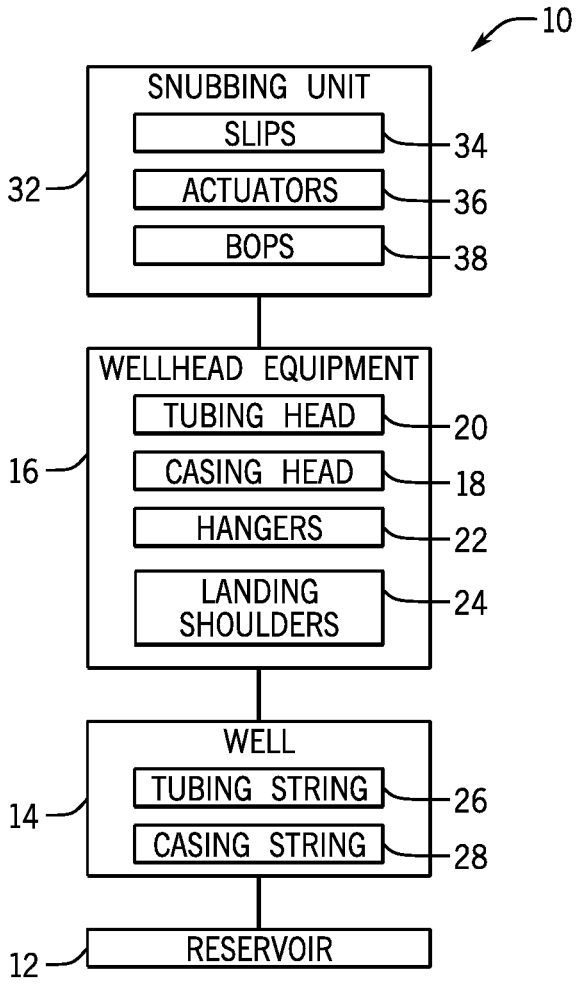
FIG. 1 generally depicts various components, including tubular strings, associated hangers, and a snubbing unit, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14, such as an onshore well. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies or landing rings disposed in the tubing and casing heads. In some instances, and as discussed in greater detail below, a wellhead hanger 22 can be secured within a hollow wellhead body using a gripping device without landing the wellhead hanger 22 on a landing shoulder 24. Each of the hangers 22 can be connected to a tubular string, such as a tubing string 26 or a casing string 28, to suspend the string within the well 14. The well 14 can include a single casing string 28 or include multiple casing strings 28 of different diameters. Casing strings 28 are often cemented in place within the well. During a cement job, cement is typically pumped down the casing string. A plug is then pumped down the casing string with a displacement fluid (e.g., drilling mud) to cause the cement to flow out of the bottom of the casing string and up the annular space around the casing string.

The system 10 also includes a snubbing unit 32 coupled to the wellhead equipment 16. The snubbing unit 32 facilitates installation of hangers 22 and tubular strings under pressure and can include any suitable components. As generally depicted in FIG. 1, the snubbing unit 32 includes slips 34, actuators 36, and blowout preventers 38. The slips 34 hold the tubular string and may include traveling slips that move in strokes to lower (or raise) the tubular string into (or from) the well and stationary slips that hold the tubular string to allow repositioning of the traveling slips between strokes. Actuators 36, such as a hydraulic jack, provide the power to push or pull the tubular string via the traveling slips. Blowout preventers 38 seal around the tubular string and control well pressure. In at least some embodiments, the blowout preventers 38 include ram preventers, but the blowout preventers 38 may also or instead include one or more annular preventers. As will be appreciated, upper and lower preventers 38 may be opened and closed in sequence to facilitate passage of larger-diameter components, such as pipe upsets or wellhead hangers, during snubbing.

Figure 2:
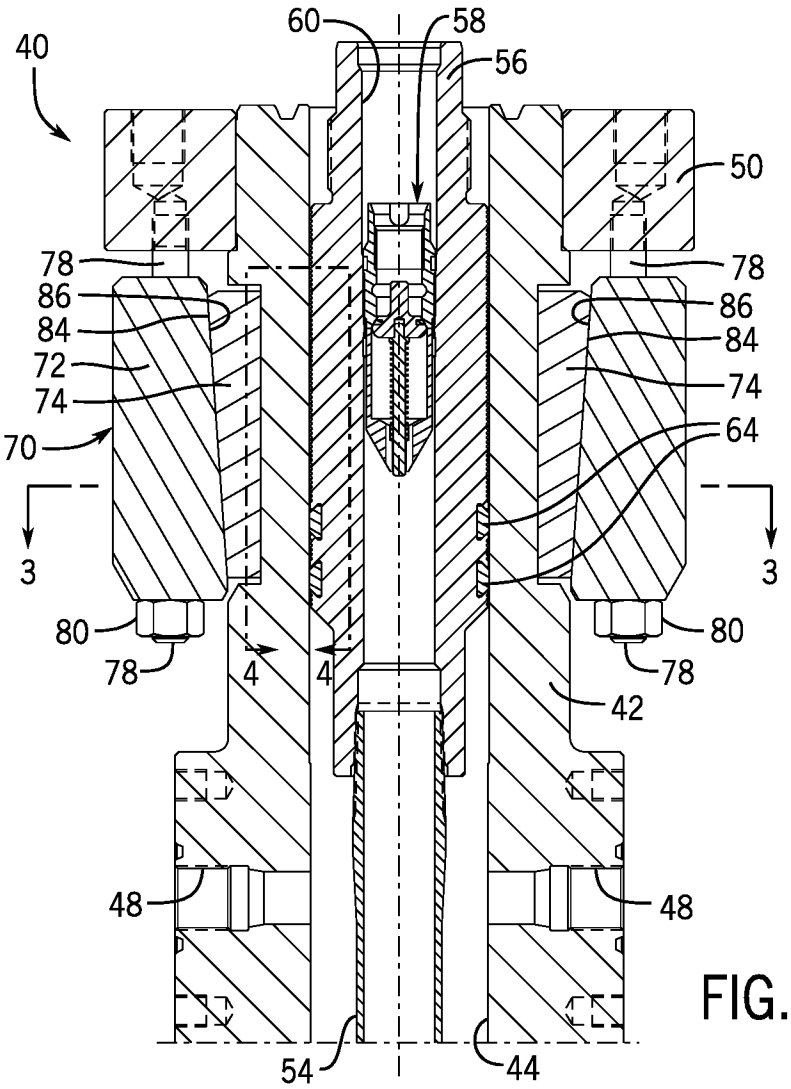
FIG. 2 depicts a wellhead assembly having a gripping device that elastically deforms a wellhead housing to securely hold a tubing hanger snubbed into the wellhead housing in accordance with one embodiment.

By way of further example, a wellhead assembly 40 is generally depicted in FIG. 2. The assembly 40 has a pressure-containing outer body, shown in FIG. 2 as including a hollow wellhead housing 42 with an axial bore 44. Although shown as a tubing head in FIG. 2, the hollow wellhead housing 42 may be provided as a different pressure-containing outer body, such as a casing head, in other embodiments. Valves 46 (FIG. 6) may be coupled to the wellhead housing 42 to control flow into and out of the axial bore 44 through ports 48. The wellhead assembly 40 can include one or more flanges 50 to facilitate connection to other components. An example of such a flange 50 is shown in FIG. 2 as a removable flange 50 threaded onto the top of the wellhead housing 42, but other flanges may also or instead be used (e.g., at the bottom of the housing 42). The flanges 50 can be removable from or integral with the wellhead housing 42.

As noted above, various tubular strings can extend downwardly from a wellhead into the well. In FIG. 2, for instance, a tubing string 54 is suspended from a tubing hanger 56 secured at a location in the bore 44. The tubing string 54 can include tubing joints threaded together to form the tubing string 54. The tubing string 54 may have any suitable diameter, but in some embodiments has a two-and-three-eighths-inch diameter or a two-and-seven-eighths-inch diameter. While a tubing string 54 and tubing hanger 56 are shown in FIG. 2, the snubbing and gripping techniques described herein may also or instead be used for installing other wellhead hangers and tubular strings, such as casing hangers and casing strings. The wellhead hangers may be mandrel-style hangers, such as the tubing hanger 56 in FIG. 2, or may take other forms, such as slip-style hangers. The hangers can be lowered from the snubbing unit 32 into the bore 44 on landing joints coupled to the hangers.

An obstruction 58 can be installed in a bore 60 of the tubing hanger 56. In FIG. 2, the obstruction 58 is depicted as a backpressure valve but may take other forms, such as a plug. The obstruction 58 may be threaded into the bore 60, such as shown in FIG. 2, or secured in the bore 60 in some other manner. The tubing hanger 56 also has seals 64 about its exterior perimeter. The seals 64 may be made of any suitable material and shape, but are annular, elastomeric seals in at least some embodiments. When energized between the bore wall of the bore 44 and the body of the tubing hanger 56, these circumferential seals 64 prevent fluid communication along the tubing hanger 56 between the spaces above and below the hanger 56. That is, the energized seals 64 isolate pressure in the region below the tubing hanger 56 from pressure in the region above the tubing hanger 56.

In some other techniques, seals on the exterior of a tubing hanger are energized and seal against a bore wall before the tubing hanger is landed within the bore, with the seals dragging along the bore wall as the tubing hanger is pushed against well pressure and lowered to its landed position in the wellhead. With a backpressure valve or other obstruction in the bore of the tubing hanger and the exterior seals preventing flow past the exterior of the tubing hanger as the tubing hanger is snubbed into the wellhead, the regions above and below the tubing hanger are isolated from one another and a pressure differential may exist between these regions. In such cases, pressure above and below the tubing hanger may be balanced with a lubricator tool to facilitate installation of the hanger.

In contrast to those other techniques, however, at least some embodiments of the present disclosure include a hanger that is snubbed into a wellhead housing to a desired location and then set using a gripping device that elastically deforms the wellhead housing to secure the hanger and hold it in place within the bore while supporting the tubing load plus any pressure loads from above or below. This manner of setting and securing the hanger may allow for a greater degree of play between the hanger and the wellhead housing prior to setting without sacrifice to sealing upon setting. That is, in at least some instances this may avoid interference between the wellhead housing and exterior seals of the hanger during movement of the hanger to its desired position in the bore and may allow post-snubbing seal testing to be avoided. The wellhead assembly 40 of FIG. 2 is one example of such an embodiment, in which a gripping device 70 is used to elastically deform the wellhead housing 42 to securely grip the tubing hanger 56 and energize the seals 64.

Figure 3:
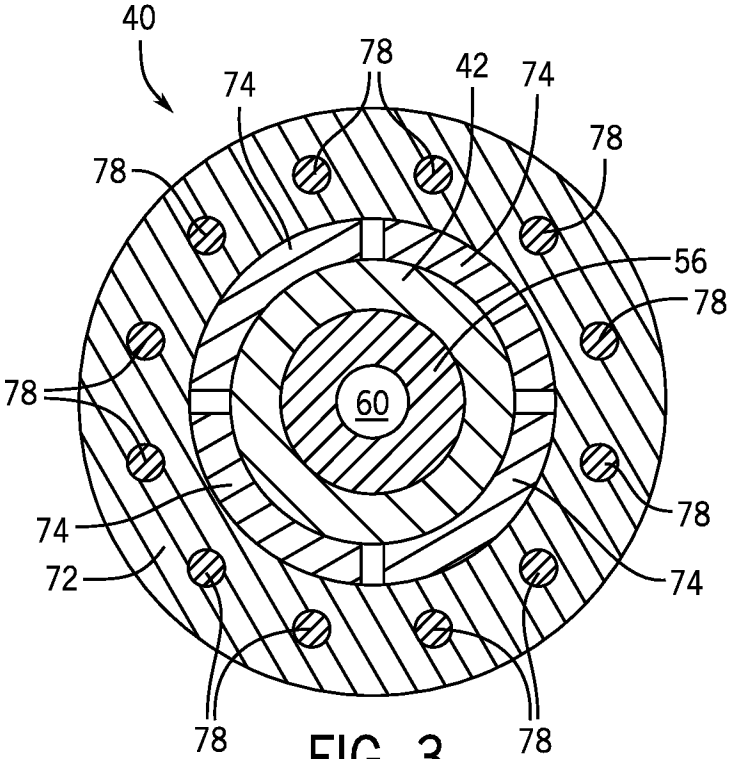
FIG. 3 is a cross-section of the wellhead assembly of FIG. 2 and shows the gripping device having a compression ring with segments that apply a radially inward force to elastically deform the wellhead housing and grip the tubing hanger in accordance with one embodiment.

As an example, the gripping device 70 is shown in FIG. 2 as a clamp having a compression ring 74 in a collar or bowl 72 positioned radially outward of the wellhead housing 42 and the tubing hanger 56. This clamp applies an inwardly directed compression force to grip the tubing hanger 56 by elastically deforming the wellhead housing 42 inward into tight engagement with the tubing hanger 56 so as to securely hold the hanger 56 within the bore 44. The compression ring 74 can have any suitable form. In some embodiments, the ring 74 is a segmented ring having multiple pieces (e.g., two to six pieces), which may be circumferentially arranged about the wellhead housing 42 within the bowl 72 in a manner similar to slips. More specifically, as depicted in FIG. 3, the ring 74 is a segmented ring having four segments in the form of tapered wedges that are deflected inward and squeeze the wellhead housing 42 to elastically deform the wellhead housing 42 and grip the tubing hanger 56. In other instances, however, the ring 74 may be an annular ring with a split in its circumference (i.e., a C-ring) or a continuous ring.

The gripping device 70 may be coupled to other equipment of the wellhead assembly 40 in any suitable manner. In FIG. 2, for instance, the gripping device 70 is fastened to and suspended from a flange 50 of the wellhead housing 42. In this depicted embodiment the bowl 72 is fastened to the wellhead housing 42 with studs 78 and nuts 80, but other fasteners, such as bolts, may also or instead be used. Although only two studs 78 and nuts 80 are depicted in FIG. 2, it will be appreciated that the gripping device 70 can include any suitable number of studs 78 and nuts 80, such as twelve (FIG. 3) or sixteen circumferentially arrayed studs 78 with nuts 80 fastening the bowl 72 to a flange 50 of the wellhead housing 42.

Radial compressive forces may result from the tightening of nuts 80 (or bolts) to drive the bowl 72 upward along an incline or deflecting surface. More specifically, with reference to the embodiment of FIG. 2, as the bowl 72 is driven upward toward the flange 50 during tightening of the gripping device 70, a tapered inner surface 86 of the bowl 72 moves along mating tapered outer surfaces 84 of the tapered wedge segments of ring 74. This mating engagement of the surfaces 84 and 86 pushes the segmented compression ring 74 inwardly, which applies a radially inward compression force against an exterior of the wellhead housing 42 to elastically deform the wellhead housing 42 inward to sealably set and anchor the tubing hanger 56 in the bore 44.

Figure 4:
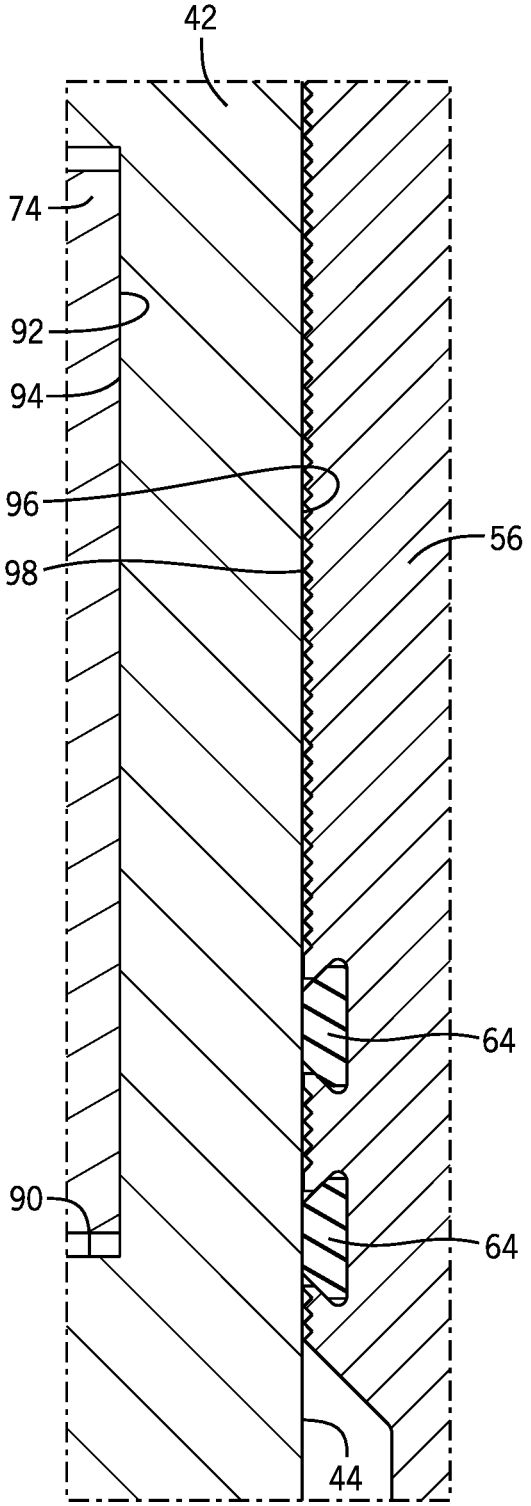
FIG. 4 is a detail view of FIG. 2 and shows the wellhead housing elastically deformed to securely grip the exterior of the tubing hanger in accordance with one embodiment.

As shown in further detail in FIG. 4, for instance, the compression ring 74 is positioned along a reduced-diameter portion (e.g., in a circumferential groove 90) of the wellhead housing 42 and tightened, with an inner surface 92 of the compression ring 74 (or of each segment thereof) applying a radially inward compressive force on an exterior surface 94 of the wellhead housing 42. This inward compressive force elastically deforms the wellhead housing 42 inward such that an inner surface 96 of the wellhead housing 42 applies a radial load to and tightly grips an outer surface 98 of the tubing hanger 56 in an interference fit. In this locked state, such as shown in FIG. 4, this grip on the tubing hanger 56 may be sufficient to securely hold the hanger 56 in place within the bore 44 while supporting tubing load (e.g., from tubing string 54) plus any pressure loads from above or below. The tubing hanger 56 may have a toothed outer surface 98, such as shown in FIG. 4, to facilitate gripping by the elastically deformed wellhead housing 42.

Figure 5:
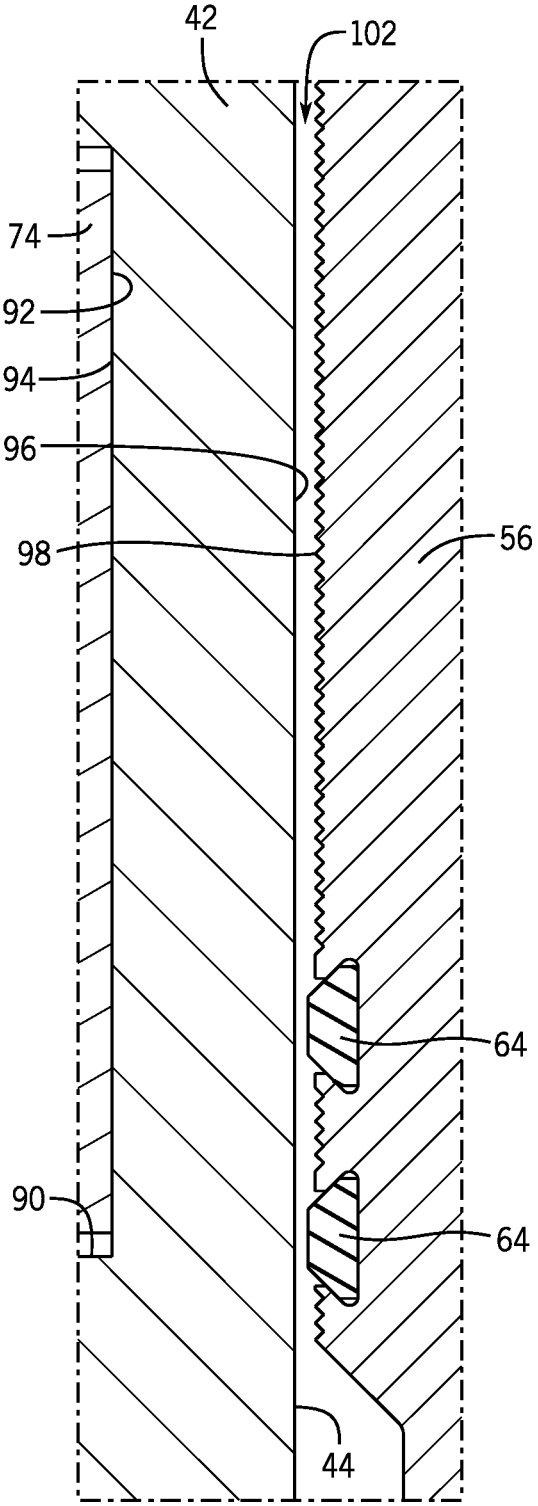
FIG. 5 is a detail view like that of FIG. 4 but shows the wellhead housing and the gripping device in a relaxed state, in which the gripping device is not elastically deforming the wellhead housing to securely grip the exterior of the tubing hanger, in accordance with one embodiment.

The elastic deformation of the wellhead housing 42 also compresses seals 64 of the tubing hanger 56 to energize these seals 64 and prevent fluid communication past the tubing hanger 56 along its exterior. Although two seals 64 are presently shown in FIG. 4, a single seal 64 or more than two seals 64 could be used to seal between the tubing hanger 56 and the wellhead housing 42 in other instances. To facilitate running of the tubing hanger 56 into or out of the wellhead housing 42, inward compressive force from the gripping device 70 may be reduced (e.g., by loosening nuts 80) or avoided so as to not elastically deform the wellhead housing 42. In this relaxed state, as shown in FIG. 5, the wellhead housing 42 does not grip the tubing hanger 56 and the seals 64 are not energized between the wellhead housing 42 and the body of the tubing hanger 56. As such, the tubing hanger 56 may be snubbed into the wellhead housing 42 from the snubbing unit 32 and lowered to a desired setting location in the bore 44 without interference from the wellhead housing 42.

Further, in this relaxed state, fluid pressure above and below the tubing hanger 56 may be balanced while lowering the tubing hanger 56 with the obstruction 58 into the bore 44 by allowing flow along the exterior of the tubing hanger 56 past the seals 64 and through a gap 102 between the wellhead housing 42 and the tubing hanger 56. Once the tubing hanger 56 is positioned at the desired setting location, the gripping device 70 may be used to elastically deform the wellhead housing 42 from the relaxed state to the locked state to securely grip the hanger 56, such as described above. Even when the hanger 56 is lowered into the bore 44 under pressure with a backpressure valve or other obstruction 58 installed, this process can eliminate the need to lubricate a differential of pressures above and below the hanger 56 because the seals 64 on the hanger 56 are not energized until the grip is enacted.

Figure 6:
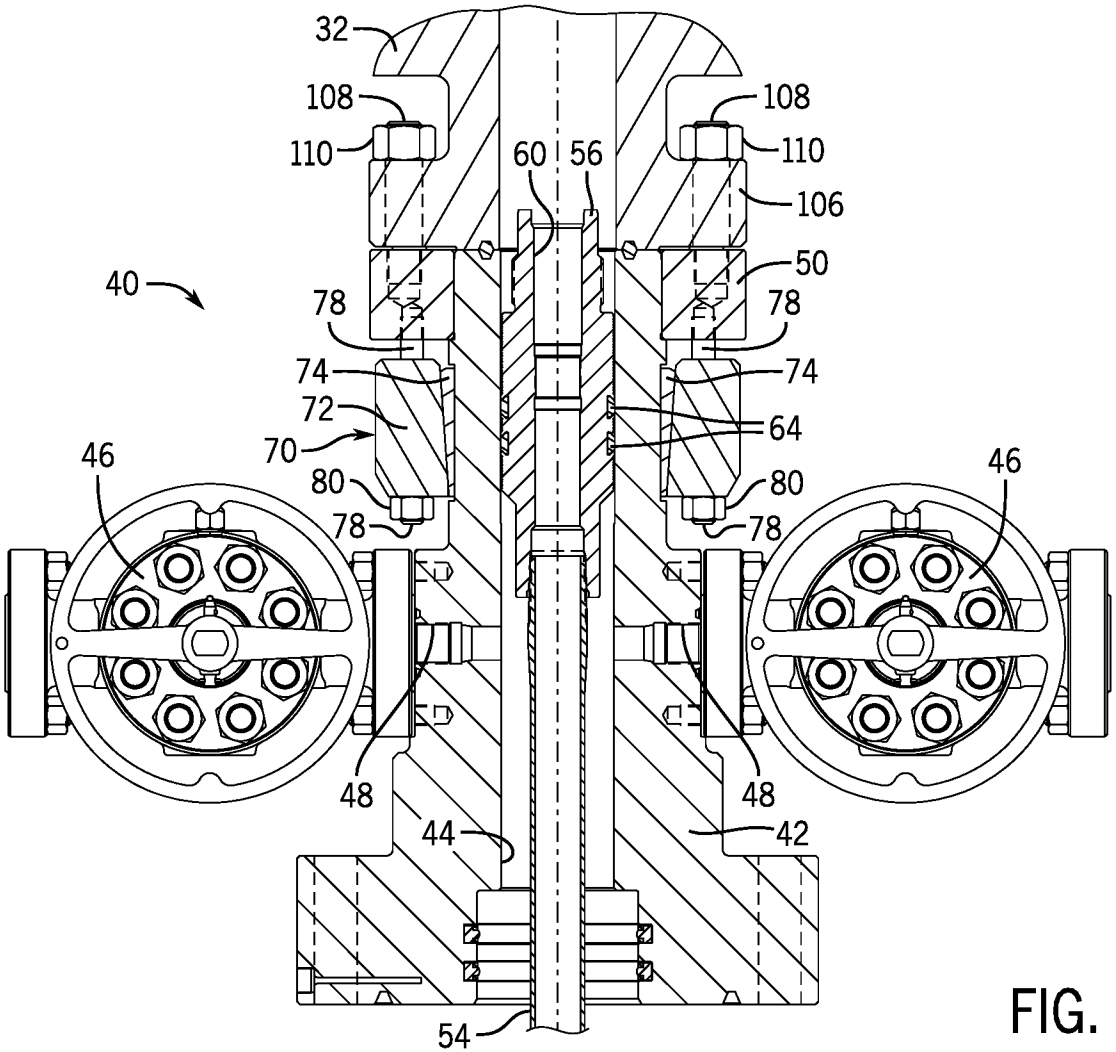
FIG. 6 depicts a wellhead assembly with a snubbing unit mounted on a wellhead housing, and a gripping device that elastically deforms the wellhead housing to securely hold a tubing hanger snubbed into the wellhead housing, in accordance with one embodiment.
Figure 7:
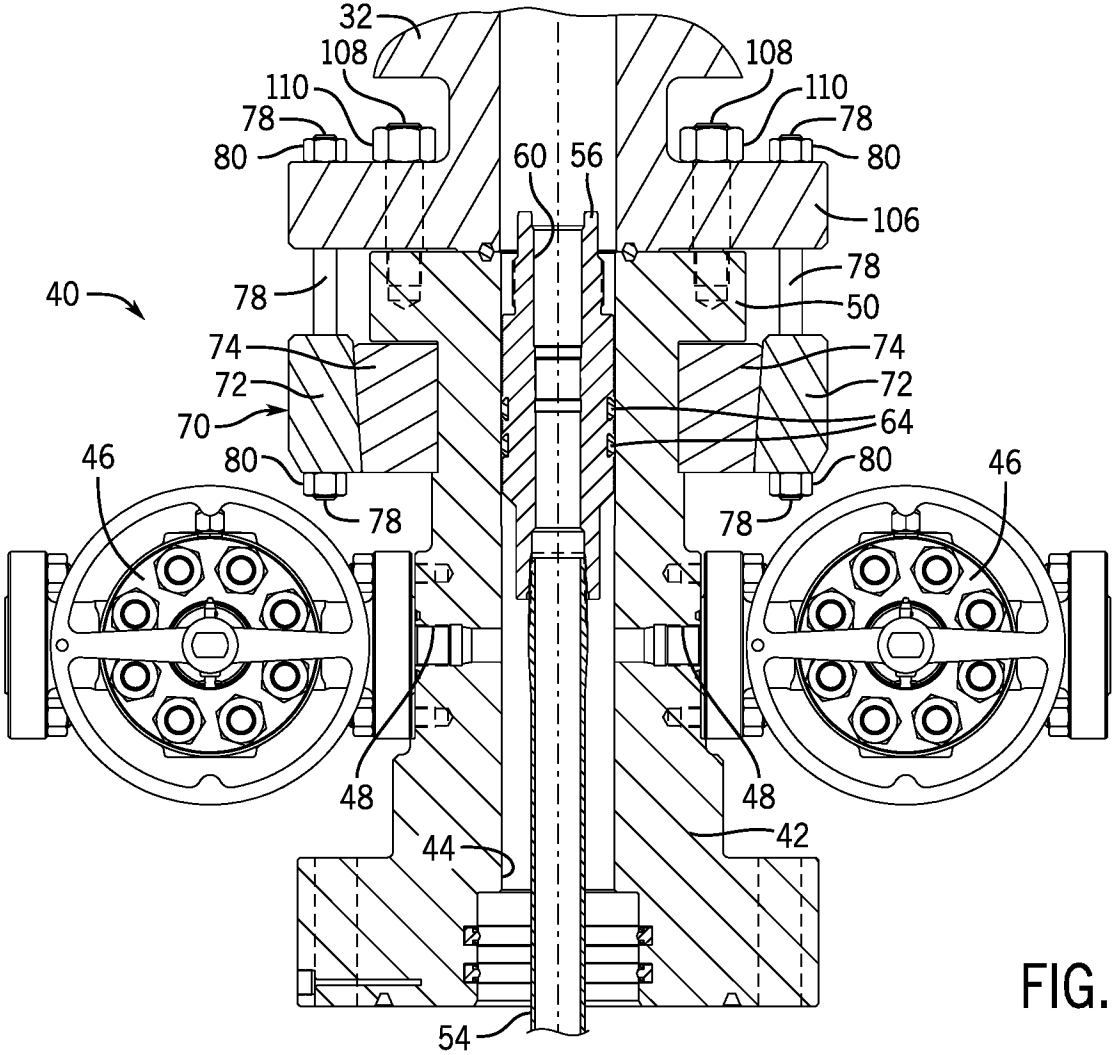
FIG. 7 depicts a wellhead assembly like that of FIG. 6 but with the gripping device fastened to the snubbing unit in accordance with one embodiment.

In at least some embodiments, such as those depicted in FIGS. 2, 6, and 7, the tubing hanger 56 is not landed on a load shoulder in the wellhead assembly 40. Instead, the grip of the tubing hanger 56 by the wellhead housing 42 (provided by the gripping device 70) is sufficient to fully support the tubing load suspended from the hanger 56 and to securely hold the hanger 56 against any pressure loads from above the hanger 56. And in some instances, this grip of the tubing hanger 56 by the elastic deformation of the wellhead housing 42 is sufficient to hold the hanger 56 against any pressure loads from below the tubing hanger 56. In such cases, and as depicted in FIGS. 2, 6, and 7, the tubing hanger 56 may be held in the bore 44 by the grip without securing the hanger 56 with tiedown pins. The tubing hanger 56 depicted in FIGS. 2, 6, and 7 does not carry a locking mechanism (e.g., a lock ring) and may be snubbed into and secured entirely by gripping elastic deformation of the wellhead housing 42 without rotation in the bore 44 (i.e., without rotation of the tubing hanger 56 or of a locking mechanism in the wellhead housing 42).

Additional examples of the wellhead assembly 40 are depicted in FIGS. 6 and 7. Although shown with slight differences, the gripping devices 70 function in a manner like that described above, in which a compression ring 74 (e.g., a segmented ring) applies an inward radial compression force to elastically deform the wellhead housing 42 and securely grip the hanger 56. The snubbing unit 32 may be coupled to the wellhead housing 42 in any suitable manner. FIGS. 6 and 7, for instance, depict a lower end of the snubbing unit 32 coupled to the wellhead housing 42 via a flange 106, studs 108, and nuts 110. Further, in FIG. 7, the flange 106 extends radially beyond the flange 50 of the wellhead housing 42, and the gripping device 70 is fastened to the snubbing unit 32 via the flange 106, studs 78, and nuts 80, rather than to the flange 50.

Some clamps are depicted as examples of gripping devices 70 in FIGS. 2, 3, 6, and 7. But other clamps or gripping devices may also or instead be used in other embodiments. For instance, the clamps or other gripping devices 70 could be electrically or hydraulically actuated, or any other suitable technique or device may be used to provide the elastic deformation and gripping described above.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A snubbing method comprising:

snubbing a tubing hanger into a wellhead housing from a snubbing unit, wherein the wellhead housing is a tubing head and snubbing the tubing hanger into the wellhead housing includes:

lowering the tubing hanger into a bore of the wellhead housing under pressure with an obstruction installed in a bore of the tubing hanger to block fluid communication through the bore of the tubing hanger;

allowing fluid in the bore of the wellhead housing to pass along an exterior of the tubing hanger due to an annular gap between the exterior of the tubing hanger and an interior surface of the wellhead housing to balance fluid pressure above and below the tubing hanger as the tubing hanger is lowered into the bore of the wellhead housing; and positioning the tubing hanger at a location in the bore of the wellhead housing; and elastically deforming the wellhead housing to grip and secure the tubing hanger at the location in the bore of the wellhead housing.

2. The snubbing method of claim 1, wherein:

lowering the tubing hanger into the bore of the wellhead housing under pressure includes lowering the tubing hanger with at least one seal disposed about the exterior of the tubing hanger into the bore of the wellhead housing under pressure; and allowing fluid in the bore of the wellhead housing to pass along the exterior of the tubing hanger to balance fluid pressure above and below the tubing hanger as the tubing hanger is lowered into the bore of the wellhead housing includes allowing fluid in the bore of the wellhead housing to pass the at least one seal disposed about the exterior of the tubing hanger.

3. The snubbing method of claim 2, wherein elastically deforming the wellhead housing to grip and secure the tubing hanger at the location in the bore of the wellhead housing includes elastically deforming the wellhead housing to energize the at least one seal and prevent fluid communication past the at least one seal along the exterior of the tubing hanger.

4. The snubbing method of claim 1, wherein positioning the tubing hanger at the location in the bore of the wellhead housing does not include landing the tubing hanger on a load shoulder in the bore of the wellhead housing.

5. The snubbing method of claim 1, wherein lowering the tubing hanger into the bore of the wellhead housing under pressure with the obstruction installed in the bore of the tubing hanger includes lowering the tubing hanger into the bore of the wellhead housing under pressure with a back-pressure valve installed in the bore of the tubing hanger.

6. The snubbing method of claim 1, wherein the tubing hanger is snubbed into and secured within the wellhead housing without rotation in the bore.

7. The snubbing method of claim 1, wherein elastically deforming the wellhead housing to grip and secure the tubing hanger at the location in the bore of the wellhead housing includes using a clamp to apply a compressive force that elastically deforms the wellhead housing.

8. The snubbing method of claim 1, comprising coupling the snubbing unit to the wellhead housing.

9. A system comprising:

a tubing head;

a tubing hanger positioned at a location in an axial bore of the tubing head;

a snubbing unit coupled to the tubing head to allow the tubing hanger to be snubbed into the tubing head to the location in the axial bore from the snubbing unit, wherein the tubing head and the tubing hanger are sized such that an annular gap between an exterior of the tubing hanger and an interior surface of the tubing head allows fluid in the axial bore to pass along the exterior of the tubing hanger through the annular gap as the tubing hanger is snubbed into the tubing head; and a gripping device that, when engaged, applies a radially inward compression force that elastically deforms the tubing head inward so as to apply a radial load to the tubing hanger that securely holds the tubing hanger at the location in the axial bore.

10. The system of claim 9, wherein the gripping device is fastened to the tubing head.

11. The system of claim 9, wherein the gripping device is fastened to the snubbing unit.

12. The system of claim 9, wherein the gripping device is a clamp.

13. The system of claim 9, wherein the tubing hanger is not landed on a load shoulder in the bore.

14. The system of claim 9, wherein the tubing hanger is not secured in the bore with tiedown pins.

15. A system comprising:

a wellhead housing, wherein the wellhead housing is a tubing head;

a tubing hanger positioned at a location in an axial bore of the wellhead housing;

a snubbing unit coupled to the wellhead housing to allow the tubing hanger to be snubbed into the wellhead housing to the location in the axial bore from the snubbing unit, wherein the tubing head and the tubing hanger are sized such that an annular gap between an exterior of the tubing hanger and an interior surface of the tubing head allows fluid in the axial bore to pass along the exterior of the tubing hanger through the annular gap as the tubing hanger is snubbed into the tubing head; and a clamp encircling the wellhead housing and the tubing hanger positioned at the location in the axial bore, wherein the clamp is arranged to elastically deform the wellhead housing from a first state that allows the tubing hanger to be snubbed into the wellhead housing to the location in the axial bore without interference from the wellhead housing to a second state in which the wellhead housing grips the tubing hanger in an interference fit that securely holds the tubing hanger at the location in the axial bore.

16. The system of claim 15, wherein the clamp includes a compression ring positioned to apply a radially inward compression force to elastically deform the wellhead housing from the first state to the second state.

17. The system of claim 16, wherein the compression ring is a segmented ring.

18. The system of claim 17, wherein the segmented ring includes tapered wedges.

19. The system of claim 15, wherein the clamp includes fasteners that can be rotated to tighten the clamp and elastically deform the wellhead housing from the first state to the second state.

* * * * *